US005717149A

United States Patent [19]

Nagel et al.

[11] Patent Number: 5,717,149

[45] Date of Patent: Feb. 10, 1998

[54] METHOD FOR PRODUCING HALOGENATED PRODUCTS FROM METAL HALIDE FEEDS

[75] Inventors: Christopher J. Nagel, Wayland, Mass.; Robert D. Bach, Gross Pointe, Mich.; Michael J. Stephenson, Oak Ridge, Tenn.; James E. Johnston, Waltham, Mass.

[73] Assignee: Molten Metal Technology, Inc., Waltham, Mass.

[21] Appl. No.: 460,887

[22] Filed: Jun. 5, 1995

[51] Int. Cl.[6] ..... C22B 60/00

[52] U.S. Cl. ..... 75/398; 75/399; 75/437; 75/500; 588/201

[58] Field of Search ..... 588/201; 75/398, 75/399, 437, 500

[56] References Cited

U.S. PATENT DOCUMENTS

| | | | |
|---|---|---|---|
| 3,168,369 | 2/1965 | Reese et al. | 23/14.5 |
| 3,235,327 | 2/1966 | Blundell et al. | 23/14.5 |
| 3,260,575 | 7/1966 | Heestand et al. | 23/355 |
| 3,547,598 | 12/1970 | Knudsen | 23/355 |
| 3,765,844 | 10/1973 | Rode | 423/19 |
| 3,843,766 | 10/1974 | Anderson et al. | 423/11 |
| 3,845,193 | 10/1974 | Edgar et al. | 423/261 |
| 3,867,510 | 2/1975 | Miller et al. | 423/251 |
| 3,906,081 | 9/1975 | Welty | 423/261 |
| 3,978,194 | 8/1976 | Knudsen et al. | 423/261 |
| 4,005,178 | 1/1977 | Bennett et al. | 423/259 |
| 4,020,146 | 4/1977 | Knudsen | 423/261 |
| 4,053,559 | 10/1977 | Hart et al. | 423/261 |
| 4,112,055 | 9/1978 | Artaud | 423/261 |
| 4,397,824 | 8/1983 | Butler et al. | 423/260 |
| 4,552,588 | 11/1985 | Elliott | 75/84.4 |
| 4,635,570 | 1/1987 | Ewest et al. | 110/237 |
| 4,655,827 | 4/1987 | Sanjurjo et al. | 75/84.4 |
| 4,695,447 | 9/1987 | Shultz | 423/659 |
| 4,830,841 | 5/1989 | Urza | 423/261 |
| 5,202,100 | 4/1993 | Nagel et al. | 423/5 |
| 5,322,545 | 6/1994 | Gilchrist | 75/399 |
| 5,346,684 | 9/1994 | Mestepey | 423/488 |
| 5,348,567 | 9/1994 | Chappell | 75/10.66 |
| 5,348,689 | 9/1994 | Gay et al. | 588/18 |
| 5,421,850 | 6/1995 | Dube et al. | 75/10.19 |
| 5,421,855 | 6/1995 | Hayden, Jr. et al. | 75/393 |

FOREIGN PATENT DOCUMENTS

| | | |
|---|---|---|
| 0198949 | 10/1986 | European Pat. Off. . |
| 2 355 359 | 1/1978 | France . |
| 2 557 557 | 7/1985 | France . |
| 9320898 | 10/1993 | WIPO . |

*Primary Examiner*—Ngoclan Mai

*Attorney, Agent, or Firm*—Hamilton, Brook, Smith & Reynolds, P.C.

[57] ABSTRACT

A method and apparatus producing halogenated products from metal halide feeds. In one embodiment, uranium hexafluoride is treated by separating fluorine from the metal of the uranium hexafluoride. Uranium hexafluoride is introduced into a molten metal bath under conditions whereby the uranium hexafluoride in the presence of hydrogen and oxygen can react to form a uranium dioxide and anhydrous hydrogen fluoride. The anhydrous hydrogen fluoride is removed from the molten metal bath as a gas stream and the uranium dioxide is discharged as a ceramic phase.

97 Claims, 5 Drawing Sheets

$UF_6(g) + 2H_2O(g) = UO_2F_2 + 4HF(g)$ $UO_2F_2 + H_2O(g) = 1/3\,U_3O_8 + 1/6\,O_2(g) + 2HF(g)$ $UO_2F_2 + H_2(g) = UO_2 + 2HF(g)$ $U_3O_8 + 2H_2(g) = 3UO_2 + 2H_2O(g)$ $UO_2 + 1/3\,O_2(g) = 1/3\,U_3O_8$ $UF_6(g) + H_2(g) = UF4 + 2HF(g)$ $UF4 + 2H_2O(g) = UO_2 + 4HF(g)$

METHOD FOR PRODUCING HALOGENATED PRODUCTS FROM METAL HALIDE FEEDS

BACKGROUND OF THE INVENTION

Metal halides represent a growing industrial waste problem. On the other hand, some halogenated compounds, such as anhydrous hydrogen fluoride, are valuable raw materials.

For example, after about fifty years of gaseous uranium diffusion plant operation, over 500,000 metric tons of isotopically depleted uranium hexafluoride tails have accumulated in the United States. Uranium hexafluoride, which is highly corrosive and a radiation risk, is used in the gaseous diffusion process for separating isotopes of uranium. However, there is a growing concern regarding the long term environmental risks associated with the continued storage of uranium hexafluoride in storage cylinders.

Typically, radioactive waste is disposed of by burial in specially prepared disposal sites which are lined or capped, or in deep underground mines. However, large volumes of radioactive waste are difficult to contain. For example, landfills can develop leaks over time, thereby allowing radioactive components to leach from landfill site and into municipal water supplies. Also, mines can become flooded and contaminate water and subsequently escapes. Further, suitable space for storage of radioactive waste is limited. The rate at which radioactive waste is generated is also much greater than the rate at which new burial sites are becoming available.

Various uranium conversion processes have been developed to convert uranium hexafluoride radioactive waste, for example, into uranium oxide for fabrication of nuclear fuel using two basic approaches: wet processing and dry processing. The wet process is based on precipitation of uranium oxides from an aqueous solution to form a uranium oxide powder. However, wet processing has the disadvantages of generating a large quantity of aqueous secondary waste, poor fluidity of the oxide powder and complicated processing requirements. Wet processing also suffers from the disadvantage that hydrogen fluoride generated by the process is hydrated and, consequently, has little commercial value.

The second process is a dry process involving hydrolysis and the reduction of uranium hexafluoride with superheated steam and hydrogen using fluidized beds, rotating kilns or flame reactors. However, the dry process involves operating with a highly corrosive medium at elevated temperatures, and reliable trapping of radioactive aerosols is required. Further, the overall reaction kinetics of uranium reduction is slow; at conditions allowed by equipment, and considerable excess steam, sometimes five to ten times the stoichiometric amount, is required to drive the chemical process to completion at the temperatures typically employed. Even then extended residence time in the reaction zone is necessary to sufficiently react the uranium intermediates to form uranium dioxide.

Therefore, a need exists for a more economical method for treating metallic compounds and, in particular, for efficiently separating the fluorine from depleted uranium hexafluoride.

SUMMARY OF THE INVENTION

The present invention relates to a method and apparatus for producing a halogenated product from a metal halide feed.

The method includes providing a reactor containing a molten metal bath, the molten metal bath having a free energy of halogenation, under the temperature and halide partial pressure conditions of the reactor, greater than that for the conversion of the metal halide feed to the halogenated product. A metal halide feed is directed into the molten metal bath at a rate and condition which causes the metal halide to interact with a halogenated product-forming reactant. The halogenated product-forming reactant is directed into the reactor. Conditions are established and maintained in the reactor to cause the metal halide to react with the reactant, thereby forming a halogenated product that is discharged from the molten metal bath for subsequent recovery.

In one embodiment, the invention relates to a method and apparatus for treating uranium hexafluoride. In this embodiment, the method includes directing uranium hexafluoride into a molten metal bath, and directing a chemical reactant into the molten metal bath, whereby the chemical reactant reacts with the uranium hexafluoride to form a uranium product.

In another embodiment, the chemical reactant is a metal reactant, such as magnesium or calcium, whereby the metal reactant reacts with the uranium hexafluoride to form elemental uranium metal or a uranium metal alloy, and a metal fluoride.

In still another embodiment, the method includes directing uranium hexafluoride into a reaction zone that includes a molten metal bath, and directing a hydrogen-containing gas into the reaction zone, whereby hydrogen of the hydrogen-containing gas reduces a portion of the uranium hexafluoride to form uranium tetrafluoride and anhydrous hydrogen fluoride. An oxygen-containing compound or composition, such as steam, is directed into the reaction zone, whereby at least a portion of the uranium tetrafluoride reacts to form uranium dioxide and anhydrous hydrogen fluoride. The hydrogen-containing compound and the oxygen-containing compound can be directed into the reaction zone either separately or conjointly.

The system for treating uranium hexafluoride includes, for example, a graphite-lined reactor for containing a molten metal bath, an injector at the reactor for introduction of uranium hexafluoride into the reactor, a uranium hexafluoride source at the injector, a reducing agent source at the injector, and an oxidizing agent source at the injector.

Basic advantages of this invention include more favorable thermodynamics, as well as the catalytic effects of the bath metal, resulting in generally greater process throughputs compared to existing technology. Other advantages of this invention include converting uranium hexafluoride in a single stage process that does not require the handling of a uranium intermediate, such as $UO_2F_2$ and uranium tetrafluoride. Also, the formed metallic oxide, such as uranium dioxide in a highly densified vitreous form, can be easily separated from the molten metal bath. Separating and collecting $UO_2$ as a dense solid can offer economic advantages over existing methods, both from a storage vantage point and a product utilization. The highly favorable thermodynamics can also afford a ceramic phase that is not highly contaminated with uranium fluorides. In addition, the method typically avoids generating aqueous waste. The hydrogen fluoride formed can provide a direct source of anhydrous hydrogen fluoride without requiring further processing, such as azeotropic distillation. The other off-gas products include synthesis gas, carbon monoxide and hydrogen gas, that can be collected and used as a low BTU fuel or as a feed stock.

DETAILED DESCRIPTION OF THE INVENTION

The features and other details of the method and apparatus of the invention will now be more particularly described with reference to the accompanying drawings and pointed out in the claims. The same numeral present in different figures represents the same item. It will be understood that the particular embodiments of the invention are shown by way of illustration and not as limitations of the invention. The principal features of this invention can be employed in various embodiments without departing from the scope of the invention. All parts and percentages are by weight unless otherwise specified.

Figure 1:
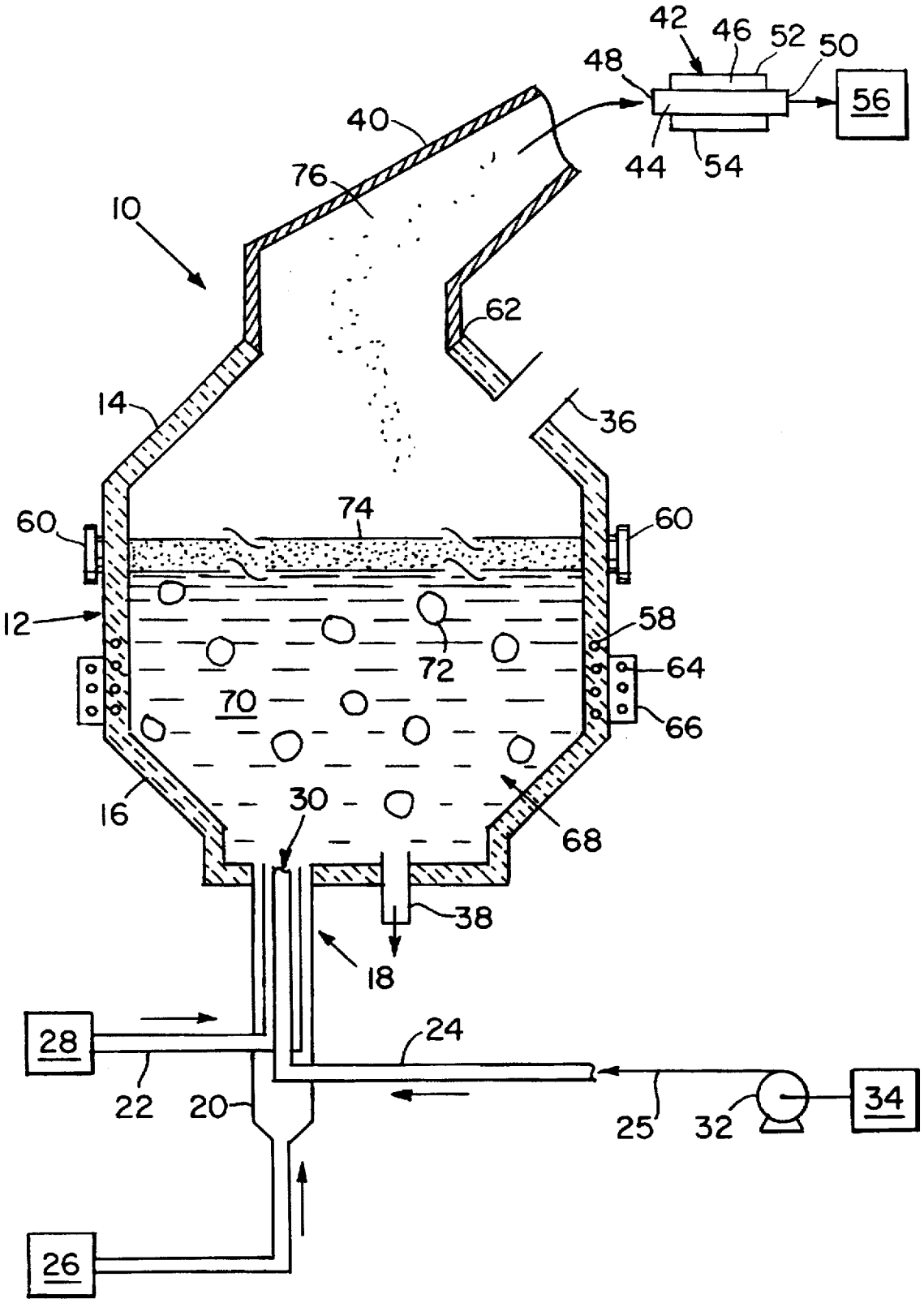
FIG. 1 is a schematic representation of a system for separating a halogen from the metal of a metallic halide by employing the method of the invention.

The invention relates to a method and apparatus for treating a metal halide, such as uranium hexafluoride. System 10, shown in FIG. 1, is one illustration of a system suitable for conducting the method of the invention. System 10 includes reactor 12. Examples of suitable reactors include known or modified reactors and furnaces, such as K-BOP, Q-BOP, argon-oxygen decarbonization (AOD), EAF, etc., such as are employed in the art of steelmaking. Examples of other suitable systems for conducting the method of the invention are disclosed in U.S. Pat. Nos. 4,574,714, 4,602,574, 5,177,304 and 5,301,620, the teachings of all of which are incorporated herein by reference in their entirety. The reactor has upper portion 14 and lower portion 16.

The interior of reactor 12 is lined with a suitable refractory material that is resistant to chemical reaction with the reactants and products formed by the method. Examples of a suitable refractory material include multiple grades of graphite, with or without protective refractory coatings, such as lanthanum-based coatings, including $LaB_6$, $La_2O_3$, $LaCrO_3$, etc. Other types of linings include, for example, uranium dioxide, and rare earth refractories, such as fluorinated rare earth refractories. The reactor can, alternatively, contain, for example, a lanthanum-based coated refractory, an actinide-based refractory, a uranium dioxide-based refractory, a thorium-dioxide based refractory, a refractory surface created by skulling the reaction melt, or more than one type of refractory material. Methods of forming protective coatings over refractory materials within reactor, such as by skull a bath metal, are taught in U.S. Ser. No. 08/388,640, filed Feb. 14, 1995, the teachings of which are incorporated herein by reference in their entirety.

Tuyere 18 includes shroud gas tube 20, uranium hexafluoride inlet tube 22 and steam inlet tube 24. Conduit 21 extends from shroud gas source 26. Conduit 23 extends from metal halide source 28 to metal halide inlet tube 22. Metal halide inlet tube 22 is disposed within shroud gas tube 20 at tuyere opening 30. Inlet tube 24 is disposed within uranium hexafluoride inlet tube 22 at tuyere opening 30. Pump 32 is disposed at conduit 25 to direct a suitable chemical reactant, such as oxygen gas or hydrogen gas, from source 34 to inlet 24.

Tuyere 18 is dimensioned and configured for introducing a metal halide, at least one reactant, and optionally, a suitable shroud gas into reactor 12. It is to be understood, however, that the shroud gas, the metal halide and another chemical reactant, or reactants, such as oxygen gas and/or hydrogen gas, can be introduced into reactor 12 separately or conjointly and continuously or intermittently. Generally, it is to be understood that the process can be operated continuously or in a batch mode.

It is also to be understood that more than one tuyere 18 can be disposed in reactor 12 and that a single pipe, concentric, or multiple concentric tuyeres, can be employed for separate introduction of reactants, such as the metal halide and chemical reactant, into reactor 12. For example, the metal halide can be introduced through a first double concentric tuyere, not shown, and a chemical reactant, such as oxygen gas, can be separately introduced through a second double concentric tuyere, also not shown, as an alternative to employing tuyere 18. Double concentric tuyeres, such as for separate introduction of a metal halide and a suitable chemical reactant, can be located proximate to or remote from each other in reactor 12.

Further, it is to be understood that the metal halide and chemical reactant can be introduced into reactor 12 by other methods, such as by top blowing into reactor 12. For example, the metal halide can also be directed into reactor 12 through metal halide inlet 36 or by top blowing the metal halide into reactor 12.

Bottom-tapping spout 38 extends from lower portion 16 and is suitable for removal of at least a portion of a molten metal bath from within reactor 12. The material can also be removed by other methods, such as are known in the art. For example, material can be removed from reactor 12 by rotating reactor 12 or by employing a launder, not shown extending from metal halide inlet 36. Alternatively, the launder can extend into reactor 12 through a top hole, also not shown.

Off-gas outlet 40 is disposed at upper portion 14 of reactor 12 and extends to heat exchanger 42. Heat exchanger 42 has off-gas side 44 in cooling medium side 46. Off-gas side 44 has heat exchanger inlet 48 and heat exchanger outlet 50. Cooling medium side 46 has cooling medium inlet 52 and cooling medium outlet 54. Examples of suitable heat exchangers include water cooled hoods, shell and tube heat exchangers, etc. A suitable cooling medium can be any medium for cooling off-gas in heat exchanger 42. Suitable cooling media include, for example, water, refrigerants ethylene glycol, ethyl benzene, alcohols, etc.

Scrubber means 56 is disposed at heat exchanger outlet 50. Scrubber means 56 is suitable for exposing off-gas to conditions sufficient to remove at least a portion of off-gas from off-gas stream. As an example, scrubber means is a scrubber which can include a wet-venturi scrubber, etc. Further, it is to be understood that off-gas can be cooled, separated by other suitable methods, for example, a calcium oxide scrubber. In one embodiment, the off-gas is cooled and separated according to the method and system described in U.S. Pat. No. 5,191,154, the teachings of which are incorporated herein by reference in their entirety. Alternatively, the off-gas can and particulates suspended therein can be treated by the method and apparatus described in U.S. patent application Ser. No. 08/041,491, "Method and Apparatus for Treating a Gas Formed from a Waste in a Molten Metal Bath" and filed on Apr. 1, 1993, the teachings of which are incorporated herein by reference in their entirety.

Induction coil 58 is disposed at lower portion 16 for heating reactor 12 or for generating of heat within reactor 12. It is to be understood that, alternatively, reactor 12 can be heated by other suitable means, such as by plasma, oxyfuel burner, electric arc, etc. Trunions 60 are disposed at reactor 12 for manipulation from reactor 12 in off-gas outlet 40. Seal 62 is disposed between reactor 12 and off-gas outlet 40. Trunions 60 are suitable for allowing partial rotation of reactor 12 about trunions 60 without breaking seal 62. Alternatively, reactor 12 does not include trunions or a seal and does not rotate.

Coil 64 is exposed on the exterior of reactor 12 for transferring heat from reactor 12. Coil 64 is covered by insulation 66 and contains a suitable heat transfer medium, such as water or liquid metal. The heat transfer medium is circulated through coil 64 by a suitable means, such as a pump not shown, to thereby transfer heat from reactor 12.

A reaction zone within system 10 includes molten metal bath 68, gas layer 76 and, optionally, vitreous layer 74. Molten metal bath 68 includes at least one metal, whereby reaction of a metal halide with an oxidizing agent and/or a reducing agent will cause formation of a halogenated product. Examples of suitable metals in molten metal bath 68 include iron, copper, nickel, cobalt, tungsten, and alloys thereof. In a preferred embodiment, molten metal bath 68 includes iron, nickel or copper. It is to be understood that molten metal bath 68 can include a solution of metals. Also, it is to be understood that molten metal bath 68 can include oxides or salts of metal. Molten metal bath 68 can include more than one phase of molten metal as disclosed in U.S. Pat. No. 5,177,304, the teachings of which are incorporated herein by reference in their entirety. For example, molten metal bath 68 can include substantially immiscible molten metal phases 70,72. However, in all embodiments, a substantial portion of molten metal bath 68 is formed of at least one metal in its elemental form.

Molten metal bath 68 is formed by at least partially filling reactor 12 with at least one suitable metal. The metal is then heated to a suitable temperature by activating induction coil 64 or by other means, not shown. When two immiscible metals are introduced into reactor 12, the metals separate during melting to form distinct molten metal phases 70,72.

Vitreous layer 74 is disposed on molten metal bath 68. Vitreous layer 74 is substantially immiscible with molten metal bath 68. Vitreous layer 74 includes at least one metallic oxide or metallic fluoride. Examples of suitable metallic oxides of vitreous layer include uranium oxide, and calcium fluoride, etc. Other examples of suitable components of vitreous layer 74 include halogens, sulphur, phosphorous, rare earths, etc. Vitreous layer 74 can be formed by introducing into reactor 12 at least one suitable vitreous phase former or fluidizer. Examples of suitable vitreous phase formers or fluidizers include cryolite, calcium fluoride, sodium fluoride, aluminum fluoride, and aluminum oxide, etc. It is to be understood that vitreous layer 74 can include more than one metallic oxide or metallic fluoride. Vitreous layer 74 can contain more than one phase. Typically, vitreous layer 74 is substantially fluid so that free radicals and other. gas can pass across vitreous layer 74 from molten metal bath 68.

Gas layer 76 is disposed over molten metal bath 68 and vitreous layer 74. In one embodiment, gas layer 76 extends from upper portion 14 of reactor 12 through off-gas outlet 40 to scrubber means 56. Gas layer 76 includes off-gases which are reaction products, such as hydrogen fluoride, carbon monoxide, carbon dioxide and hydrogen gas.

Suitable operating conditions of system 10 include those which can cause a chemical reactant to react with a metal halide in the molten metal bath to form a halogenated product. In one embodiment, the temperature of molten metal bath 68 is in the range of between about 1,000° and about 2,000° C.

The metal halide is directed into molten metal bath 68 from the metal halide source 28. Suitable metal halide feeds can include: oxyhalides; nitrates; actinides; uranium; uranium halides, such as uranium fluorides, including, for example, uranium hexafluoride; iron, iron chlorides, such as $FeCl_3$ and $FeCl_2$; etc. Examples of suitable metallic fluorides include the fluorides of the actinide series. Also, the metallic fluorides of metals from Groups 4A, 5A, 6B, 7B and 8 of the Periodic Table. Particular examples of the metals of metallic fluorides that can be treated by the method of the invention include tungsten, vanadium and rhodium. These metals can be radioactive or, alternatively, non-radioactive.

The metal halide can, however, be directed into reactor 12 by other suitable methods. For example, the metal halide can be directed into reactor 12 to metal halide inlet 36 as a top blown gas.

A chemical reactant is directed from source 34 through line 24 and tuyere 18 into molten metal bath 68. It is to be understood that the chemical reactant can be an oxidizing reactant or a reducing reactant. Examples of other suitable oxidizing reactants include oxygen gas, water, alcohols, ketones, and suitable metal oxides, that will react with uranium hexafluoride or some other metal fluoride. Specific examples of suitable metal oxides include calcium oxide, aluminum oxides (such as alumina), silicon dioxide, etc. In one embodiment, the oxidizing reactant is fed to the reactor, under the operating conditions of the reactor, in about 1:1 stoichiometric ratio of oxygen to the oxidizable portion of the metal halide feed.

Suitable reducing agents include, for example, hydrogen and hydrogen-containing compounds that dissociate to form elemental hydrogen gas. Examples of suitable hydrogen-containing compounds include organic compounds, such as hydrocarbons, including alkanes and aromatic hydrocarbons. The shroud gas can be suitable for cooling the region within reactor 12 proximate to tuyere 18 under the operating conditions of system 10 and for providing a source of a reducing agent, such as hydrogen and carbon. Examples of suitable shroud gases include methane, ethane, propane and butane, nitrogen, and steam. The shroud gas can also include hydrogen and oxygen. Other suitable halogenated product-forming reactants can include: Group 1A elements; Group 2A elements; hydrogen; calcium; magnesium; etc. Other suitable non-halogenated product forming reactants include: oxidizing agents; reactants that include a reducible metal oxide; reactants that include steam; reactants that include inorganically bound oxygen; etc.

Where hydrogen gas is employed as a reducing reactant and steam is employed as an oxidizing reactant to treat uranium hexafluoride by the method of the invention, it is believed that chemical reactions that occur in the reaction zone or in molten metal bath 68 include the following:

$$UF_6(g)+2H_2O(g)\rightarrow UO_2F_2+4HF$$

$$UF_6(g)+H_2(g)\rightarrow UF_4+2HF$$

$$UO_2F_2+H_2O(g)\rightarrow \tfrac{1}{3}U_3O_8+\tfrac{1}{6}O_2(g)+2HF(g)$$

$$UO_2F_2+H_2(g)\rightarrow UO_2+2HF(g)$$

$$UO_2F_2+H_2(g)\rightarrow \tfrac{1}{2}UO_2+\tfrac{1}{2}UF_4+H_2O(g)$$

$$U_3O_8+2H_2(g)\rightarrow 3UO_2+2H_2O(g)$$

$$UO_2+\tfrac{1}{3}O_2(g)\rightarrow\tfrac{1}{3}U_3O_8$$

$$UF_4+2H_2O\rightarrow UO_2+2HF(g)$$

Alternatively, where another oxidizing chemical reactant, such as a suitable oxide, is employed, uranium dioxide and a metal fluoride are formed. In another embodiment, if a suitable reducing agent, such as magnesium or calcium, rather than steam or some other oxidizing reactant, is employed, then the uranium hexafluoride can be directly reduced to elemental uranium metal. The resulting elemental uranium mesal can form an alloy with the molten metal of molten metal bath 68. Other possible chemical reactions are disclosed in U.S. Pat. No. 5,202,100 and U.S. Ser. No. 08/046,016, filed Apr. 12, 1993, the teachings of both of which are incorporated herein in their entirety.

Figure 2:
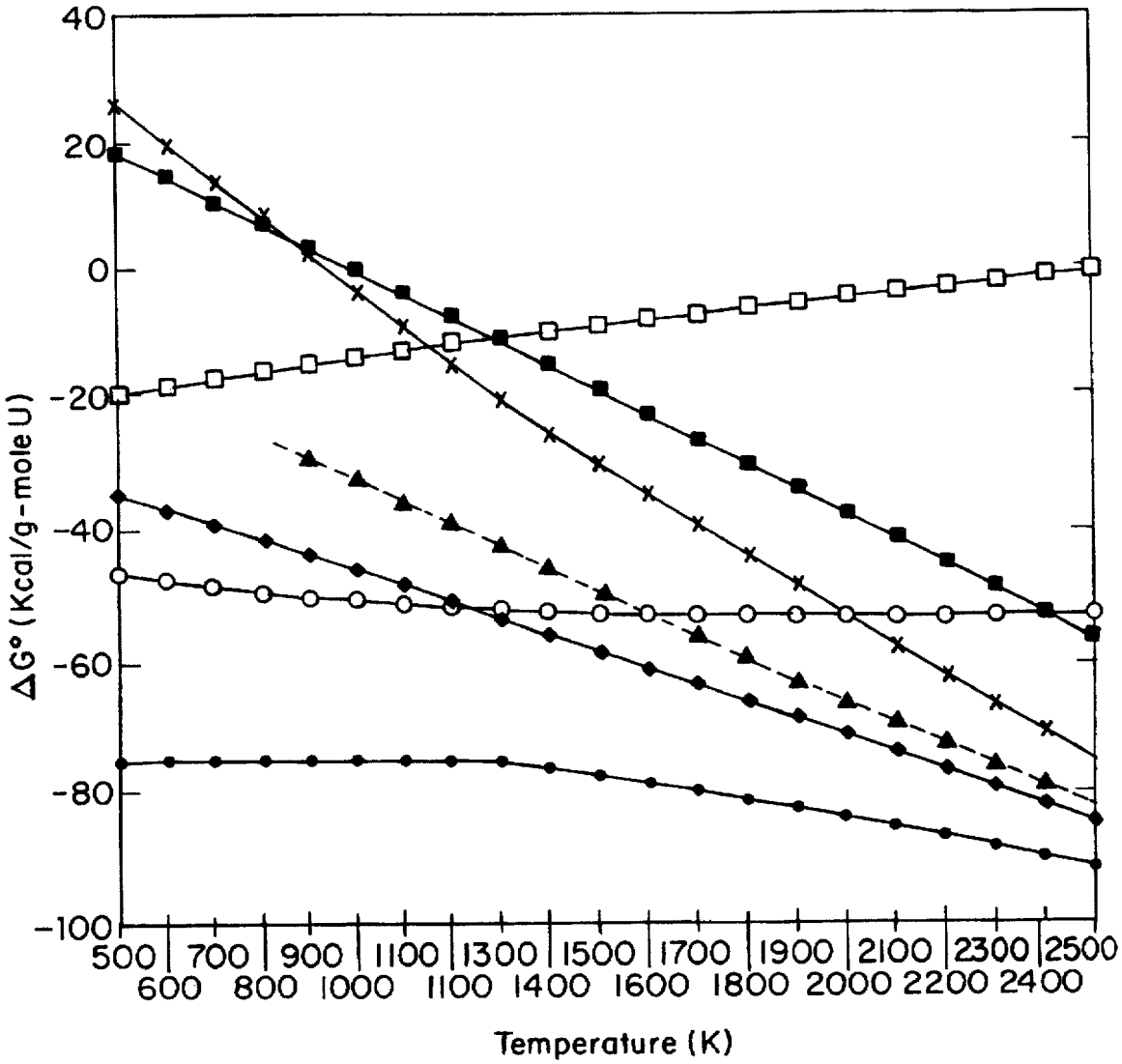
FIG. 2 is a plot of the free energies of oxidation of uranium conversion reactions.

The Gibbs standard free energy change ($\Delta G°$) for the high-temperature conversion of uranium hexafluoride and various uranium intermediates are shown graphically in FIG. 2 to illustrate the thermodynamic advantage of conducting the method in a temperature range of between about 1,500° and 1,600° C. (1,773° and 1873° K). Consideration of free energy values allow predictions of the direction and extent of a given reaction, as well as the effect of temperature, pressure and composition. The criterion of a spontaneous reaction as written (left to right), at constant temperature and pressure, is a negative $\Delta G°$ value. Reaction rate, although not predicted from free energy data, is usually sufficiently great at elevated temperatures that diffusion of the reactants and products to and from the reaction zone determines the actual rate. Thus, if the free energy indication is favorable, these metallurgical reactions will proceed at a reasonable rate.

Figure 3:
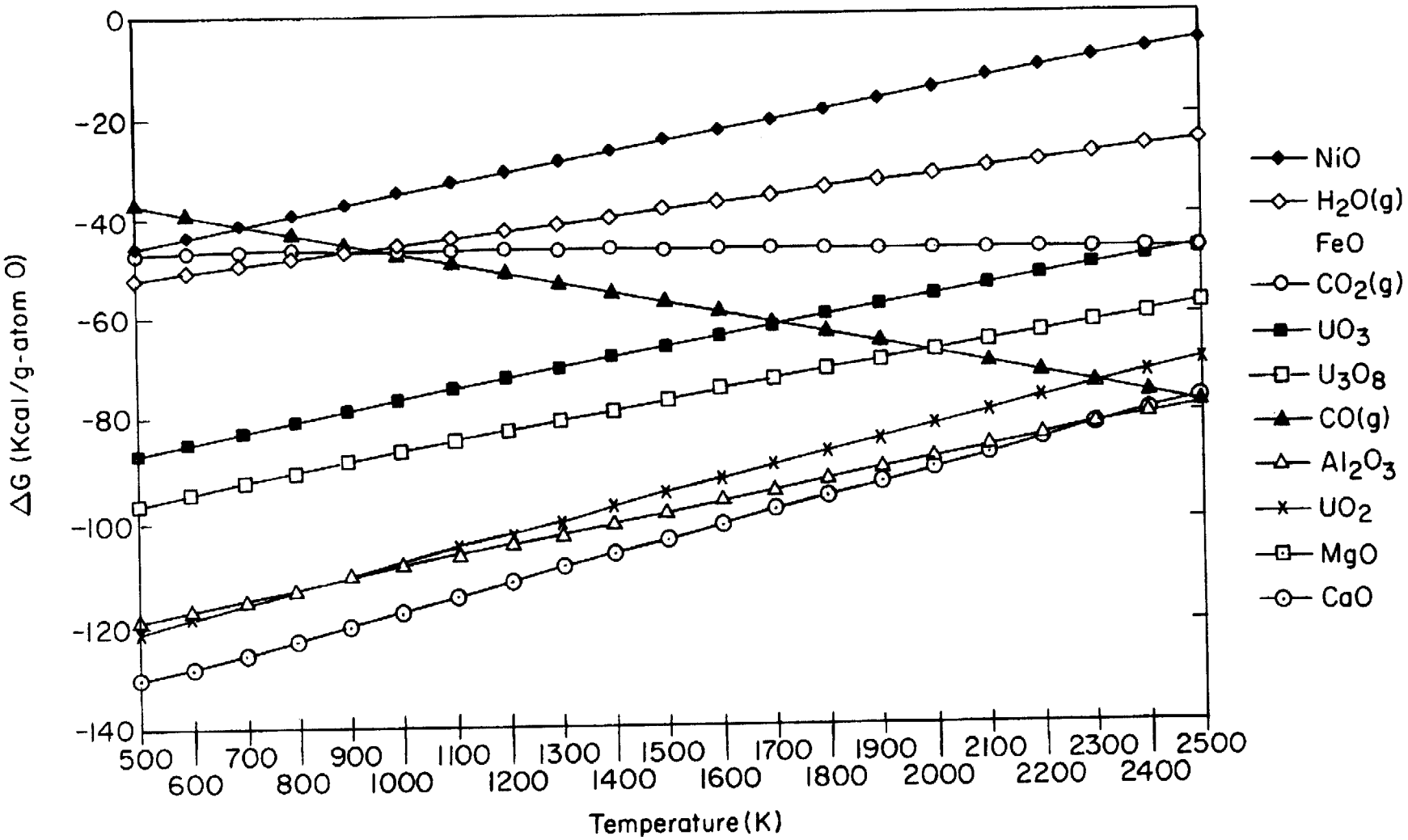
FIG. 3 is a plot of the free energies for selected oxides.

Other considerations include the chemical stability of uranium oxide vitreous phase in contact with the molten metal bath, the chemical stability of hydrogen fluoride with the particular molten metal, as well as the chemical stability of hydrogen fluoride in contact with the reactor refractory and back reaction of the product uranium oxide. Free energy of formation of selected oxides are shown graphically in FIG. 3 to illustrate the chemical priority of the system relative to the formation of metallic oxides. The more negative the value of $\Delta G°$, the more stable the oxide. At a given temperature, a particular metal is able to displace the oxide of all other metals with less negative free energy, provided all reactants and products are in their standard states. The fact that many of the $\Delta G°$ curves cross each other indicates that the stability of the oxides, relative to each other, change as the temperature increases.

As hydrogen and oxygen are added to molten metal bath 68 containing uranium fluorides and partially oxidized uranium fluorides, such as uranium oxyfluorides, oxides of uranium are formed preferentially to oxides of the bath metal, and separate as a ceramic phase into vitreous layer 74 in reactor 12. Optionally, addition of carbon, such as by use of a hydrocarbon as a shroud gas, to molten metal bath 68 can cause reaction of the carbon with any available oxygen, above the amount of oxygen needed for stoichiometric uranium conversion of uranium hexafluoride to desired products, and thereby minimize formation of metallic oxides of the bath metal. Because the free energy of formation of iron or nickel oxide is less negative than carbon monoxide, formation of carbon monoxide occurs preferentially. Thermodynamically, the formation of iron or nickel oxide is significantly less favorable than uranium oxides at the operating temperature of molten metal bath 68.

Figure 4:
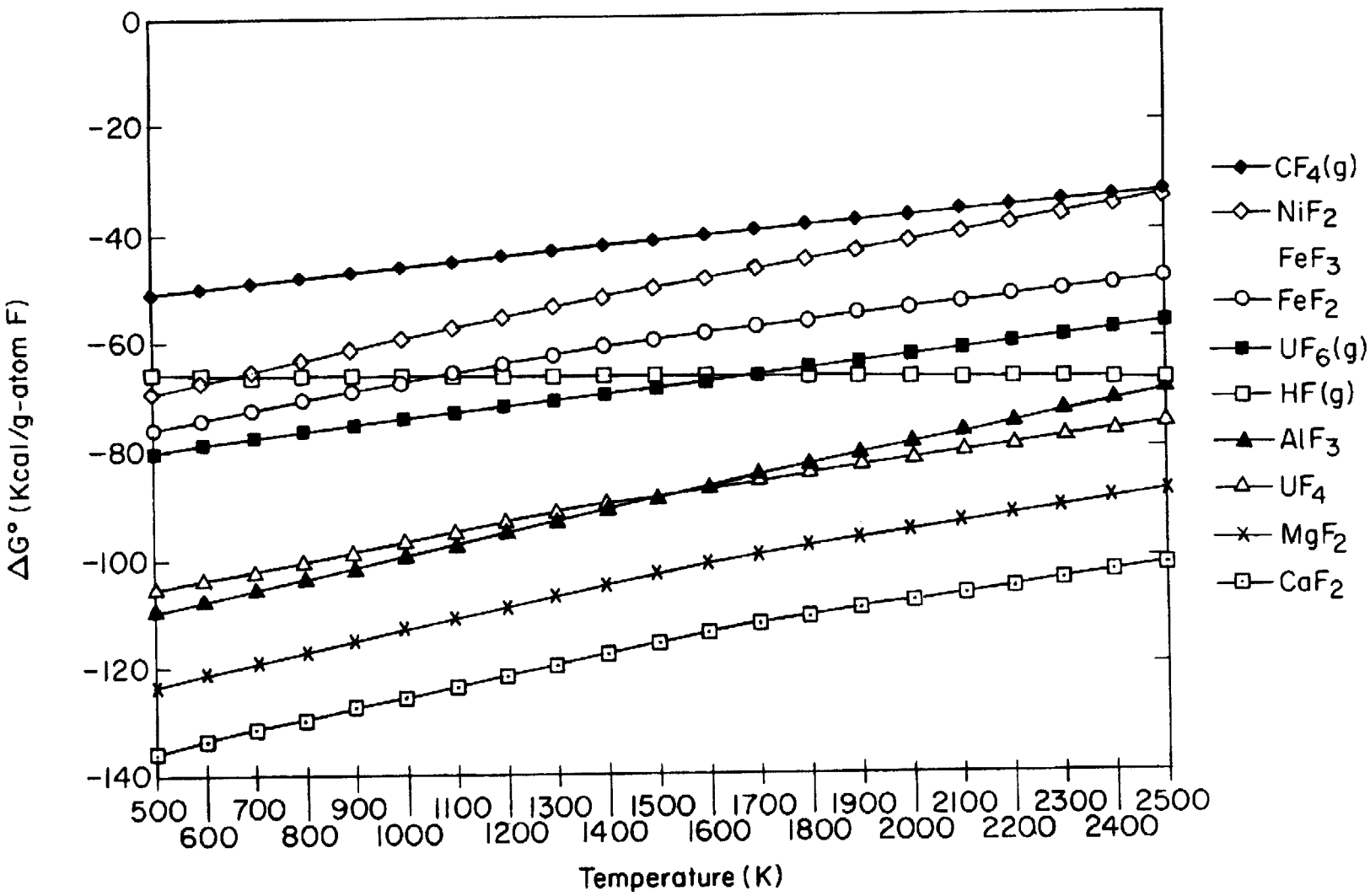
FIG. 4 is a plot of the free energies for selected fluorides.

As long as hydrogen, uranium and other more active metals are present in molten metal bath 68, a fluoride of the bath metal is not a significant byproduct of the process, as shown graphically in FIG. 4. If the $\Delta G°$ value of a particular uranium hexafluoride lies above the $\Delta G°$ value for hydrogen fluoride at a given temperature, the uranium hexafluoride will be reduced to the metal by hydrogen, provided the substances are in their standard states. A metal whose fluoride lies below the hydrogen fluoride curve will be converted to the fluoride by treatment with hydrogen fluoride under standard conditions. Of particular note, the $\Delta G°$ curves for both iron and nickel lie above the hydrogen fluoride curve at higher temperatures, thereby allowing operation of reactor 12 with a molten metal bath, such as a iron or nickel in a reducing environment.

Hydrogen fluoride generated by the method of the invention is generally anhydrous and is removed as a gas from reactor 12 through off-gas outlet 40. The resulting uranium dioxide substantially migrates to vitreous layer 74, which can then be separated from molten metal bath 68 for continuous or intermittent discharge from reactor 12 by a suitable means, such as is described in U.S. Pat. No. 5,301,620, the teachings of which are incorporated herein by reference. In the absence of a vitreous phase 74, the metal oxide can form a separate phase in molten metal bath 68.

Other halogenated products that can be generated by the method of the invention include products that contain, for example: hydrogen; fluorine; chlorine; a haloacid, such as an anhydrous haloacid; hydrogen chloride; a metal halide, such as calcium chloride ($CaCl_2$); magnesium chloride ($MgCl_2$); calcium fluoride ($CaF_2$); magnesium fluoride ($MgF_2$); etc.

Examples of non-halogenated products that can be formed by the method of the invention include products that contain, for example: oxygen, such as an oxide of iron or uranium; a metal, such as iron or an iron alloy, uranium or a uranium alloy; a product that has a bulk density greater than 3 grams/cc; a product that is fully dense; a product that can be removed from the reactor as a liquid; a product that contains less than about 50 ppm of uranium-bound fluorine. It is to be understood that products of the reaction can be recovered sequentially.

Figure 5:
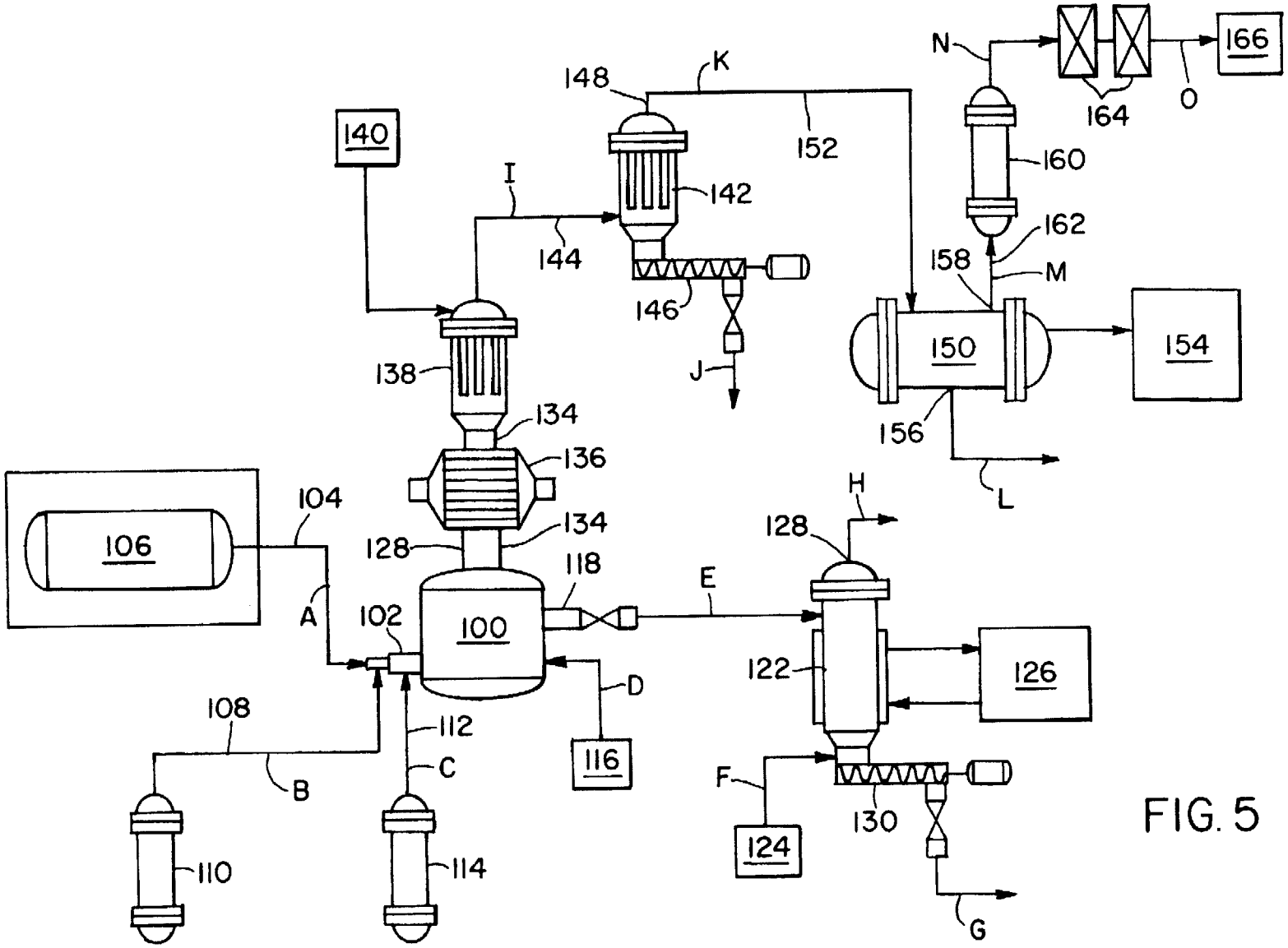
FIG. 5 is a schematic representation of a second system for separating fluorine from the metal of a uranium hexafluoride by employing the method of the invention.

Shown in FIG. 5 is a second embodiment of an apparatus for separating fluorine from the metal of a uranium hexafluoride. It is to be understood, however, that although the apparatus shown in FIG. 5 is described in terms of treating uranium hexafluoride with hydrogen and oxygen, other reactants, such as other metal halides, can be employed, alternatively, to form other products, as described above.

The system includes molten metal reactor 100 for holding a molten metal bath. An example of a suitable reactor is described and shown in FIG. 1. Also, U.S. Pat. No. 5,301,620 discloses a suitable reactor which allows continuous and separate discharge of the molten metal, vitreous and gas phases. Inlet tuyere 102 is for the conjoint injection of the uranium hexafluoride, steam and co-feed gas by side injection. Alternatively, injection can be from the bottom or the top of reactor 68. Conduit 104 extends from uranium hexafluoride source 106 to molten metal reactor 100. Inlet tuyere 102 is also connected by conduit 108 to reactant source 110. Reactant source 110 includes heater and also has an option for including hydrogen gas or some other reactant in reactant source 110. Also, conduit 112 is connected to inlet tuyere 102 for conducting co-feed material from co-feed source 114 to inlet tuyere. Co-feed source 114 includes hydrocarbon source material, such as methane, and also can include hydrogen and oxygen gases and a shroud gas.

Uranium hexafluoride source 106 can be heated by a steam heated autoclave or other suitable source for liquefying or vaporizing uranium hexafluoride prior to feeding material into molten metal reactor 100. Molten metal reactor 100 has metal inlet 116 for receiving additional metal into molten metal reactor 100.

Molten metal reactor 100 has vitreous phase removal outlet 118 for the continuous or periodic discharge of vitreous phase from the reactor. Vitreous phase removal outlet 118 is connected by conduit 120 uranium oxide cooler/storage hopper system 122. Uranium oxide/cooler storage hopper system 122 has argon and oxygen gas purge source 124 for removal of residual hydrogen fluoride within uranium oxide containing vitreous phase. Uranium oxide cooler/storage hopper system 122 has cooling source 126 for cooling the uranium oxide containing vitreous phase. Uranium cooler/storage hopper system 122 also has gas outlet 128 for removing argon/oxygen purge gas and residual hydrogen fluoride gas. Uranium oxide cooler/storage hopper system 122 has uranium oxide outlet 130 for removing vitreous phase to storage containers for packaging or reprocessing.

Molten metal reactor 100 has gas outlet 128 for removal of hydrogen fluoride gas and other off gases. Gas conduit 134 can conduct off-gas from gas outlet 128 to gas cooler 136 for cooling hydrogen fluoride and off gases. Gas conduit 134 further extends from gas cooler 136 to first filter 138. First filter 138 can be a sintered metal or ceramic filtration system for removing particulates. First filter 138 allows particulates collected by first filter to be blown back to molten metal reactor 100 with nitrogen gas blow back source 140. First filter 138 is connected to second filter 142 by conduit 144. Second filter is part of a two stage filtration system in combination with first filter 138. Second filter 142 can also be a sintered metal or ceramic filtration system. Second filter has uranium oxide product outlet for discharging collected uranium oxide to oxide collection system 146. Second filter 142 has filtered gas outlet 148.

Filtered gas outlet 148 is connected to hydrogen fluoride condenser 150 by conduit 152. Hydrogen fluoride condenser 150 can condense a substantial amount of hydrogen fluoride in filtered off-gas. Hydrogen fluoride condenser 150 has a refrigeration unit 154 for cooling. Hydrogen fluoride condenser 150 has hydrogen fluoride outlet 156 for removing condensed hydrogen fluoride product from hydrogen fluoride condenser and has gas outlet 158 for removing non-condensed gases from hydrogen fluoride condenser 150. Hydrogen fluoride chemical trap 160 is connected to gas outlet 158 by conduit 162. Hydrogen fluoride chemical trap can include a reactive metal oxide, such as aluminum oxide ($Al_2O_3$) or calcium carbonate ($CaCO_3$), for trapping residual hydrogen fluoride in a non-condensed gas from hydrogen fluoride condenser 150. Alternatively, a water scrubber can be used for removing hydrogen fluoride. In this embodiment, the spent aqueous scrubber liquid, can be volatilized to steam and recycled to the reactor as feed. The condensed hydrogen fluoride can be stored in standard iron storage cylinders or high density polyethylene containers. Optionally, hydrogen fluoride chemical trap 160 can be connected to HEPA filters 164 for further filtering of particulate contaminants from hydrogen fluoride condenser 156. HEPA filters 164 are connected to non-condensible gas recovery means 166.

In another embodiment, uranium metal can be formed from the uranium hexafluoride in molten metal reactor 100 by conjointly feeding a reactive metal, such as magnesium or calcium, to reduce the uranium hexafluoride. In the presence of the reactive metal, magnesium or calcium forms magnesium fluoride ($MgF_2$) or calcium fluoride ($CaF_2$), respectively. Calcium fluoride, also known as fluorspar, can be used as a fluidizing reactant in the production of hydrogen fluoride and as a refractory material. The uranium metal forms an iron-uranium or nickel-uranium alloy if an iron or nickel molten metal bath is used. The uranium alloy can be used as an enrichment process feed or further processed to recover pure uranium.

In a further embodiment, uranium dioxide is converted to uranium tetrachloride with chlorine gas and carbon monoxide. In a further step, the uranium tetrachloride is reacted with magnesium metal to form uranium metal and magnesium chloride ($MgCl_2$). This uranium-magnesium system has the advantage of allowing high-purity uranium to be formed with low uranium losses because there is essentially no mutual solubility in either the solid or liquid states. The byproduct magnesium chloride can optionally be sold directly or electrochemically reduced to magnesium metal and chlorine gas.

The invention will now be further described by the following illustrations. All percentages are by weight unless otherwise specified.

Illustration I uranium hexafluoride is conducted from uranium hexafluoride source 106 through conduit 104 to molten metal reactor 100. Molten metal reactor 100 has a molten metal bath. The molten metal bath is at a temperature and conditions at which the uranium hexafluoride in the presence of hydrogen and oxygen can react to form a metallic oxide and hydrogen fluoride. Molten metal bath can include iron or nickel at a temperature of about 1,800° C. Hydrogen gas and oxygen gas are directed from reactant source 110 through conduit 108 to inlet tuyere 102 for injection with uranium hexafluoride molten metal reactor 100. The hydrogen gas and oxygen gas dissociate upon contact with molten metal in molten metal reactor 100 into the elemental constituents of hydrogen and oxygen. Hydrogen and oxygen can react with the uranium hexafluoride to form partially oxidized fragments of uranium hexafluoride. Concurrently or subsequently, additional steam is injected into molten metal bath with hydrogen from co-feed source 114 through conduit 112 to inlet tuyere 102. The dissociated oxygen and hydrogen reactants can further react with the partially oxidized oxyfluoride intermediates to form uranium dioxide and $U_3O_8$, which accumulate in the vitreous phase of vitreous layer of molten metal 100. Excess oxygen is reacted with carbon which is also injected from co-feed source 114 conjointly or sequentially with the hydrogen.

As shown in FIG. 2, the standard free energy for selected uranium conversion reactions discloses that uranium dioxide is the predominate product at the conditions of the molten metal reactor, having a temperature of about 1,800° C. Uranium oxides are removed from molten metal reactor 100 through vitreous phase removal outlet 118 for treatment in uranium oxide cooler/storage hopper system 122. Uranium dioxide is treated with an oxygen gas purge to form $U_3O_8$.

Often, about one to two percent, by weight, of bath metal can become entrained physically with the vitreous phase. As a result, additional metal can be added periodically through metal inlet 116.

The hydrogen fluoride and other off-gases are removed from molten metal reactor 100 through gas outlet 128 through conduit 134 to off-gas cooler 136. Cooled off-gases, which can contain hydrogen fluoride, carbon monoxide and hydrogen gas, are directed through first filter 138, which can remove essentially all of any entrained oxides or other particulates in off-gas. Periodically, the entrained oxides and other particulates are recycled back to molten metal reactor via a nitrogen blow back gas from nitrogen gas blow back source 140. Off-gas is further treated in second filter 142 where any remaining entrained uranium oxide product is removed through uranium oxide collection outlet 146 and stored or further processed. The remaining filtered off-gas exits second filter 142 through filtered gas outlet 148 to hydrogen fluoride condenser 150 by conduit 152. Hydrogen fluoride gas is condensed in hydrogen fluoride condenser 150 and removed through hydrogen fluoride outlet 156 to storage. Hydrogen fluoride exiting from hydrogen fluoride outlet can essentially be anhydrous.

The remaining non-condensible gases, such as carbon dioxide, carbon monoxide and hydrogen gas, exit hydrogen fluoride condenser to hydrogen fluoride chemical traps. Often about 0.5%, by weight, of the byproduct hydrogen formed condenses with the non-condensible gases from hydrogen fluoride condenser 150 and become immobilized in the downstream chemical trap 160. However, actual hydrogen fluoride carryover is a function of hydrogen fluoride condenser operation including the temperature and pressure and non-condensible gas flow. Non-condensible gases are further filtered through HEPA filters 164. As shown in Table 1, a material balance is disclosed for the components including uranium hexafluoride, water, hydrogen, methane, molten nickel or iron, uranium dioxide, $U_3O_8$, hydrogen fluoride, carbon monoxide and oxygen. In FIG. 5, letters A through O indicate the points of component mass flow for the identified streams which are in kilograms per unit time.

Illustration II

Uranium hexafluoride is directed into molten metal reactor 100 from hydrogen hexafluoride source 106 with hydrogen gas and methane gas from co-feed source into molten metal reactor. Hydrogen gases reacts with uranium hexafluoride to form uranium tetrafluoride. The uranium hexafluoride is subsequently reacted with steam from reactant source 110 to form uranium dioxide. Similarly, the component mass flow for the identified streams in kilograms per unit time is shown in Table 2.

TABLE 1

($UF_6$---->$UO_2F_2$---->$UO_2$/$U_3O_8$)

| | Component Mass Flow (kgs/unit time) for Identified Stream | | | | | | | | | | | | | | |
|---|---|---|---|---|---|---|---|---|---|---|---|---|---|---|---|
| Component | A | B | C | D | E | F | G | H | I | J | K | L | M | N | O |
| $UF_6$ | 1000 | | | | | | | | | | | | | | |
| $H_2O$ | | 307.0 | | | | | | | | | | | | | |
| $H_2$ | | | | | | | | | 60.4 | | 60.4 | | 60.4 | 60.4 | 60.4 |
| $CH_4$ | | | 172.1 | | | | | | | | | | | | |
| Ni/Fe | | | | 15.5 | 15.5 | | 15.5 | | trace | trace | | | | | |
| $UO_2$ | | | | | 511.3 | | | | trace | trace | | | | | |
| $U_3O_8$ | | | | | 265.9 | | 797.4 | | trace | trace | | | | | |
| HF | | | | | trace | | | trace | 341.0 | | 341.0 | 339.3 | 1.7 | | |
| CO | | | | | | | | | 300.5 | | 300.5 | | 300.5 | 300.5 | 300.5 |
| $O_2$ | | | | | | 20.2 | | | | | | | | | |
| Totals | 1000 | 307.0 | 172.1 | 15.5 | 792.7 | 20.2 | 812.9 | | 701.9 | | 701.9 | 339.3 | 362.6 | 360.9 | 360.9 |

TABLE 2

($UF_6$---->$UO_2F_2$---->$UO_2/U_3O_8$)

| Component | Component Mass Flow (kgs/unit time) for Identified Stream | | | | | | | | | | | | | | |
|---|---|---|---|---|---|---|---|---|---|---|---|---|---|---|---|
| | A | B | C | D | E | F | G | H | I | J | K | L | M | N | O |
| $UF_6$ | 1000 | | | | | | | | | | | | | | |
| $H_2O$ | | | 204.8 | | | | | | | | | | | | |
| $H_2$ | | 11.4 | | | | | | | 40.1 | | 40.1 | | 40.1 | 40.1 | 40.1 |
| $CH_4$ | | | 91.1 | | | | | | | | | | | | |
| Ni/Fe | | | | 15.3 | 15.3 | | 15.3 | | trace | trace | | | | | |
| $UO_2$ | | | | | 767.1 | | | | trace | trace | | | | | |
| $U_3O_8$ | | | | | | | 797.4 | | trace | trace | | | | | |
| HF | | | | | trace | | | trace | 341.0 | | 341.0 | 339.3 | 1.7 | | |
| CO | | | | | | | | | 159.1 | | 159.1 | | 159.1 | 159.1 | 159.1 |
| $O_2$ | | | | | | 30.3 | | | | | | | | | |
| Totals | 1000 | 11.4 | 295.9 | 15.3 | 782.7 | 30.3 | 812.7 | | 540.2 | | 540.2 | 339.3 | 200.9 | 199.2 | 199.2 |

Equivalents

Those skilled in the art will recognize, or be able to ascertain using no more than routine experimentation, many equivalents to the specific embodiments of the invention described specifically herein. Such equivalents are intended to be encompassed in the scope of the claims.

We claim:

1. A method for processing uranium hexafluoride, comprising the steps of:

a) providing an aluminum-based refractory lined reactor;

b) providing a nickel metal bath in said reactor;

c) directing said uranium hexafluoride into the molten metal bath at a rate and condition which causes the uranium hexafluoride to interact with at least one reactant;

d) directing said reactant into the reactor;

e) maintaining a carbon concentration in the molten metal bath of less than about 0.1 weight percent; and f) establishing and maintaining conditions in said reactor to cause said uranium hexafluoride to react to produce recoverable uranium and fluorinated products, whereby the products are discharged from the molten metal bath for subsequent recovery.

2. A method for producing a halogenated product from a metal halide feed comprising the steps of:

a) providing a reactor containing a molten metal bath, said molten metal bath having a free energy of halogenation, under the temperature and halide partial pressure conditions of the reactor, greater than that of the metal halide feed;

b) directing said metal halide feed into the molten metal bath at a rate and condition which causes the metal halide to interact with a halogenated product-forming reactant;

c) directing said halogenated product-forming reactant into the reactor; and d) establishing and maintaining conditions in said reactor to cause said metal halide feed to react with the reactant, thereby forming a halogenated product, whereby the halogenated product is discharged from the molten metal bath for subsequent recovery.

3. A method of claim 2 wherein the bath metal includes nickel.

4. A method of claim 2 wherein the bath metal includes copper.

5. A method of claim 2 wherein the bath metal is an alloy.

6. A method of claim 2 wherein the halogenated product forming reactant includes a Group 1A element.

7. A method of claim 2 wherein the halogenated product forming reactant includes hydrogen.

8. A method of claim 2 wherein the halogenated product forming reactant includes magnesium.

9. A method of claim 2 wherein the halogenated product includes an anhydrous haloacid.

10. A method of claim 2 wherein the halogenated product includes HF.

11. A method of claim 2 wherein the halogenated product includes $CaCl_2$.

12. A method of claim 2 wherein the halogenated product includes $CaF_2$.

13. A method of claim 2 wherein the halogenated product includes $MgF_2$.

14. A method of claim 2 wherein an oxidizing reactant is fed to the reactor, under the operating conditions of the reactor, in about a 1:1 stoichiometric ratio of oxygen to oxidizable portion of the metal halide feed.

15. A method of claim 2 wherein the process is operated continuously.

16. A method of claim 2 wherein the process is operated in a batch mode.

17. A method for producing a non-halogenated product from a metal halide feed, comprising the steps of:

a) providing a reactor containing a molten metal bath, said molten metal bath having a free energy of halogenation, under the temperature and halide partial pressure conditions of the reactor, greater than that of the metal halide feed;

b) directing said metal halide feed into the molten metal bath at a rate and condition which causes the metal halide to interact with a non-halogenated product-forming reactant;

c) directing said non-halogenated product-forming reactant into the reactor; and d) establishing and maintaining conditions in said reactor to cause said metal halide feed to react with reactant, thereby forming a non-halogenated product, whereby the non-halogenated product is discharged from the molten metal bath for subsequent recovery.

18. A method of claim 17 wherein the non-halogenated product forming reactant includes an oxidizing agent.

19. A method of claim 17 wherein the non-halogenated product forming reactant includes a reducible metal oxide.

20. A method of claim 17 wherein the non-halogenated product forming reactant includes steam.

21. A method of claim 17 wherein the non-halogenated product forming reactant includes inorganically bound oxygen.

22. A method for processing at least one uranium fluoride, comprising the steps of:

a) providing a reactor containing a molten metal bath, said molten metal bath having a free energy of fluorination, under the temperature and fluorine partial pressure conditions of the reactor, greater than that of the uranium fluoride;

b) directing said uranium fluoride into the molten metal bath at a rate and condition which causes the uranium fluorides to interact with at least one product-forming reactant;

c) directing said product-forming reactant into the reactor; and d) establishing and maintaining conditions in said reactor to cause said uranium fluorides to react with the product-forming reactant to produce recoverable uranium and fluorinated products, whereby the products are discharged from the molten metal bath for subsequent recovery.

23. A method for processing uranium hexafluoride, comprising the steps of:

a) providing a graphite-lined reactor;

b) providing a molten metal bath in said reactor, said molten metal bath having a free energy of fluorination, under the temperature and fluorine partial pressure conditions of the reactor, greater than that of the uranium hexafluoride;

c) directing said uranium hexafluoride into the molten metal bath at a rate and condition which causes the uranium hexafluoride to interact with at least one product-forming reactant;

d) directing said product-forming reactant into the reactor; and e) establishing and maintaining conditions in said reactor to cause said uranium hexafluoride to react to produce recoverable uranium and fluorinated products, whereby the products are discharged from the molten metal bath for subsequent recovery.

24. A method for processing uranium hexafluoride, comprising the steps of:

a) providing a graphite-lined reactor;

b) providing a molten metal bath in said reactor, said molten metal bath having a free energy of fluorination, under the temperature and fluorine partial pressure conditions of the reactor, greater than that of the uranium hexafluoride;

c) directing said uranium hexafluoride into the molten metal bath at a rate and condition which causes the uranium hexafluoride to interact with at least one product-forming reactant;

d) directing said product-forming reactant into the reactor;

e) maintaining a carbon concentration at about the equilibrium solubility of carbon in the bath metal; and f) establishing and maintaining conditions in said reactor to cause said uranium hexafluoride to react to produce recoverable uranium and fluorinated products, whereby the products are discharged from the molten metal bath for subsequent recovery.

25. A method for processing uranium hexafluoride, comprising the steps of:

a) providing a lanthanum boride-lined reactor;

b) providing a molten metal bath in said reactor, said molten metal bath having a free energy of fluorination, under the temperature and fluorine partial pressure conditions of the reactor, greater than that of the uranium hexafluoride;

c) directing said uranium hexafluoride into the molten metal bath at a rate and condition which causes the uranium hexafluoride to interact with at least one product-forming reactant;

d) directing said product-forming reactant into the reactor; and e) establishing and maintaining conditions in said reactor to cause said uranium hexafluoride to react to produce recoverable uranium and fluorinated products, whereby the products are discharged from the molten metal bath for subsequent recovery.

26. A method for processing uranium hexafluoride, comprising the steps of:

a) providing a graphite-lined reactor;

b) providing a molten metal bath in said reactor, said molten metal bath having a free energy of fluorination, under the temperature and fluorine partial pressure conditions of the reactor, greater than that of the uranium hexafluoride;

c) directing said uranium hexafluoride into the molten metal bath at a rate and condition which causes the uranium hexafluoride to interact with at least one product-forming reactant;

d) directing said product-forming reactant into the reactor; and e) establishing and maintaining conditions in said reactor to cause said uranium hexafluoride to react to produce recoverable uranium and anhydrous hydrogen fluoride products, whereby the products are discharged from the molten metal bath for subsequent recovery.

27. A method for processing uranium hexafluoride, comprising the steps of:

a) providing a graphite-lined reactor;

b) providing a molten metal bath in said reactor, said molten metal bath having a free energy of fluorination, under the temperature and fluorine partial pressure conditions of the reactor, greater than that of the uranium hexafluoride;

c) directing said uranium hexafluoride into the molten metal bath at a rate and condition which causes the uranium hexafluoride to interact with at least one product-forming reactant;

d) directing said product-forming reactant into the reactor; and e) establishing and maintaining conditions in said reactor to cause said uranium hexafluoride to react to produce recoverable uranium oxide and calcium fluoride products, whereby the products are discharged from the molten metal bath for subsequent recovery.

28. A method for processing uranium hexafluoride, comprising the steps of:

a) providing a graphite-lined reactor;

b) providing a copper metal bath in said reactor;

c) directing said uranium hexafluoride into the molten metal bath at a rate and condition which causes the uranium hexafluoride to interact with at least one reactant;

d) directing said reactant into the reactor; and e) establishing and maintaining conditions in said reactor to cause said uranium hexafluoride to react to produce recoverable uranium and fluorinated products, whereby the products are discharged from the molten metal bath for subsequent recovery.

29. A method for processing uranium hexafluoride comprising the step of:

a) providing a reactor containing a molten metal bath, said molten metal bath having a free energy of fluorination, under the temperature and fluorine partial pressure condition of the reactor, greater than that of said uranium hexafluoride;

b) directing said uranium hexafluoride into the molten metal bath at a rate and condition which causes the uranium hexafluoride to interact with at least one reactant;

c) directing said reactant into the reactor; and e) establishing and maintaining conditions in said reactor to cause said uranium hexafluoride to react to produce recoverable uranium metal and fluorinated products, whereby the products are discharged from the molten metal bath for subsequent recovery.

30. A method of claim 29 wherein the products are recovered sequentially.

31. A method of claim 29 wherein the process is operated continuously.

32. A method of claim 29 wherein the process is operated in a batch mode.

33. A method for proceeding iron chlorides, comprising the steps of:

a) providing a reactor containing a molten metal bath, said molten metal bath having a free energy of chlorination, under the temperature and chlorine partial pressure conditions of the reactor, greater than that of the iron chlorides;

b) directing said iron chlorides into the molten metal bath at a rate and condition which causes the iron chlorides to interact with a reactant;

c) directing said reactant into the reactor; and d) establishing and maintaining conditions in said reactor to cause said iron chlorides to react to product recoverable iron and chlorinated products, whereby the products are discharged from the molten metal bath for subsequent recovery.

34. A method of claim 33 wherein the reactant includes an oxidizing agent.

35. A method of claim 33 wherein the reactant includes a reducing agent.

36. A method of claim 33 wherein the reactant includes a reducible metal oxide.

37. A method of claim 33 wherein the reactant includes steam.

38. A method of claim 33 wherein the reactant includes an organic.

39. A method of claim 33 wherein the reactant includes a hydrocarbon.

40. A method of claim 33 wherein the reactant includes carbon.

41. A method of claim 33 wherein the reactant includes inorganically bound oxygen.

42. A method of claim 33 wherein the product includes an iron alloy.

43. A method for treating uranium hexafluoride, comprising the steps of:

a) directing the uranium hexafluoride into a molten metal bath; and b) directing a chemical reactant into the molten metal bath, whereby said chemical reactant reacts with the uranium hexafluoride to form a uranium product.

44. The method of claim 43 wherein the chemical reactant is an oxidizing agent.

45. The method of claim 44 wherein the oxidizing reactant includes steam.

46. The method of claim 44 wherein the oxidizing reactant includes a metal oxide.

47. The method of claim 46 wherein the metal oxide includes a calcium oxide.

48. The method of claim 46 wherein the metal oxide includes an aluminum oxide.

49. The method of claim 48 wherein the metal oxide is alumina.

50. The method of claim 46 wherein the metal oxide includes silicon dioxide.

51. The method of claim 43 wherein the uranium hexafluoride is directed into a molten iron bath.

52. The method of claim 43 wherein the uranium hexafluoride is directed into a molten nickel bath.

53. The method of claim 43 wherein the uranium hexafluoride is directed into a molten copper bath.

54. The method of claim 43 wherein the chemical reactant is a reducing reactant.

55. The method of claim 54 wherein the reducing agent includes magnesium.

56. The method of claim 54 wherein the reducing reactant includes hydrogen gas, whereby said uranium product is uranium tetrafluoride.

57. The method of claim 56, further including the step of directing an oxidizing reactant into said bath, whereby said oxidizing reactant reacts with at least a portion of said uranium tetrafluoride to form an oxidized uranium product.

58. The method of claim 57 wherein said oxidizing reactant includes steam, whereby the oxidized uranium product includes uranium dioxide.

59. The method of claim 58, further including the step of directing a carbon-containing material into the molten metal bath, whereby at least a portion of oxygen in said molten metal bath reacts with carbon of said carbon-containing material to form a carbon oxide gas that is discharged from the molten metal bath.

60. A method for treating uranium hexafluoride, comprising the steps of:

a) directing the uranium hexafluoride into a molten metal bath;

b) directing hydrogen gas into said molten metal bath, whereby hydrogen of said hydrogen gas reduces a portion of the uranium hexafluoride to form uranium tetrafluoride and anhydrous hydrogen fluoride, said anhydrous hydrogen fluoride being discharged from the molten metal bath; and c) directing a steam into said molten metal bath, whereby at least a portion of said uranium tetrafluoride reacts to form uranium dioxide and anhydrous hydrogen fluoride, said uranium dioxide separating from the molten metal bath, and said anhydrous hydrogen fluoride being discharged from the molten metal bath.

61. The method of claim 60 wherein said molten metal bath includes iron.

62. The method of claim 60 wherein said molten metal bath includes nickel.

63. The method of claim 60 wherein said molten metal bath includes copper.

64. The method of claim 60, further including the step of directing a carbon-containing material into the molten metal bath.

65. The method of claim 60 wherein the hydrogen gas and the steam are directed into the molten metal bath conjointly with the uranium hexafluoride.

66. The method of claim 65 wherein the hydrogen gas, steam and uranium hexafluoride are directed into the molten metal bath continuously.

67. The method of claim 60 wherein the steam directed into the molten metal bath causes formation of uranium dioxide which migrates from the molten metal bath to a ceramic phase of said molten metal bath.

68. The method of claim 67 further including the step of directing an oxygen-containing gas into said ceramic phase.

69. The method of claim 68 wherein said oxygen-containing gas is air.

70. The method of claim 60 further including the step of directing at least one vitreous phase former into the reaction zone.

71. The method of claim 70 wherein the vitreous phase former includes calcium fluoride.

72. The method of claim 70 wherein the vitreous phase former includes cryolite.

73. The method of claim 69 wherein the vitreous phase former is selected from the group consisting of calcium fluoride, sodium fluoride, aluminum fluoride, and aluminum oxide.

74. The method of claim 60, further including the steps of:

a) forming a gaseous discharge stream that includes said anhydrous hydrogen fluoride;

b) cooling said discharge stream;

c) filtering said discharge stream, whereby at least a portion of any entrained uranium oxide is separated from said anhydrous fluoride; and d) condensing at least a portion of the anhydrous fluoride to form a condensed anhydrous fluoride stream and a residual gas stream.

75. The method of claim 74 further including the step of combining the residual gas stream with a metal oxide to form a metal fluoride precipitate that separates from the residual gas stream.

76. The method of claim 74 further including the step of scrubbing the residual gas stream to form a liquid stream that includes residual fluoride separated from the residual gas stream.

77. The method of claim 76 further including the steps of volatilizing the liquid stream and then directing the volatilized stream into the molten metal bath.

78. The method of claim 67 further including forming a ceramic discharge stream from said ceramic phase, whereby ceramic material is discharged from said reaction zone.

79. The method of claim 78 wherein said ceramic material is discharged continuously from said reaction zone.

80. The method of claim 79 further including the steps of cooling the ceramic material of said ceramic discharge stream and then combining said cooled ceramic material with an oxygen-containing gas, whereby at least a portion of said uranium dioxide component of said ceramic material is converted to $U_3O_8$, and whereby entrained anhydrous hydrogen fluoride is separated from the ceramic material to form an entrained hydrogen fluoride gas stream.

81. The method of claim 80 further including the step of separating the anhydrous hydrogen fluoride component from said entrained hydrogen fluoride gas stream.

82. The method of claim 80 wherein said oxygen-containing gas is air.

83. The method of claim 79 further including the steps of cooling the ceramic material of said ceramic discharge stream and combining said cooled ceramic material with carbon monoxide gas and chlorine gas, whereby at least a portion of said uranium dioxide component reacts to form uranium tetrachloride.

84. The method of claim 83 further including the step of reacting said uranium tetrachloride with magnesium to thereby form elemental uranium metal and magnesium chloride.

85. The method of claim 84 further including the step of electrochemically reducing the magnesium chloride to form an elemental magnesium metal stream and a chlorine gas stream.

86. A method for treating uranium hexafluoride, comprising the steps of:

a) directing the uranium hexafluoride into a molten metal bath; and b) directing a metal reactant into the molten metal bath, whereby said metal reactant reacts with the uranium hexafluoride to form elemental uranium metal or a uranium metal alloy, and a metal fluoride.

87. The method of claim 86 wherein said metal reactant includes magnesium.

88. The method of claim 87 wherein said metal reactant includes calcium.

89. A method of claim 2 wherein the reactant includes an oxidizing agent.

90. A method of claim 2 wherein the reactant includes a reducing agent.

91. A method of claim 2 wherein the reactant includes a reducible metal oxide.

92. A method of claim 2 wherein the reactant includes steam.

93. A method of claim 2 wherein the reactant includes an organic.

94. A method of claim 2 wherein the reactant includes a hydrocarbon.

95. A method of claim 2 wherein the reactant includes carbon.

96. A method of claim 2 wherein the reactant includes inorganically bound oxygen.

97. A method of claim 2 wherein the product includes an iron alloy.

* * * * *

UNITED STATES PATENT AND TRADEMARK OFFICE

CERTIFICATE OF CORRECTION

PATENT NO. : 5,717,149
DATED : February 10, 1998
INVENTOR(S) : Christopher J. Nagel, *et al.*

It is certified that error appears in the above-identified patent and that said Letters Patent is hereby corrected as shown below:

At Column 17, line 9, please delete "condition" and insert ---conditions---.

At Column 17, line 26, please delete "proceeding" and insert ---processing---.

At Column 17, line 39, please delete "product" and insert ---produce---.

At Column 19, line 19, please delete "69" and insert ---70---.

Signed and Sealed this
Twenty-eighth Day of April, 1998

Bruce Lehman

*Attest:*

BRUCE LEHMAN

*Commissioner of Patents and Trademarks*

*Attesting Officer*